United States Patent [19]

Norström

[11] 4,128,103

[45] Dec. 5, 1978

[54] DEGREASING APPARATUS

[75] Inventor: Göte J. W. Norström, Karlstad, Sweden

[73] Assignee: Uddeholms Aktiegolag, Gagfors, Sweden

[21] Appl. No.: 860,387

[22] Filed: Dec. 14, 1977

[30] Foreign Application Priority Data

Jan. 21, 1977 [SE] Sweden ..... 7700669

[51] Int. Cl.[2] ..... B08B 3/08; B08B 3/10

[52] U.S. Cl. ..... 134/143; 134/161; 118/58; 202/170

[58] Field of Search ..... 134/105, 143, 156, 158–161, 134/164; 202/170, 170 D; 118/58

[56] References Cited

U.S. PATENT DOCUMENTS

| | | | |
|---|---|---|---|
| 2,280,811 | 4/1942 | Edhofer et al. | 134/105 X |
| 2,619,781 | 12/1952 | Buhrer | 134/160 X |
| 2,716,989 | 9/1955 | Joy | 134/161 X |
| 3,896,829 | 7/1975 | Sabatka | 134/143 X |

FOREIGN PATENT DOCUMENTS

| | | | |
|---|---|---|---|
| 2447403 | 6/1975 | Fed. Rep. of Germany | 134/159 |
| 114156 | 6/1945 | Sweden | 134/143 |

*Primary Examiner*—Robert L. Bleutge

*Attorney, Agent, or Firm*—Toren, McGeady and Stanger

[57] ABSTRACT

A degreasing apparatus comprises a container for liquid or gaseous solvent, a basket-holder arranged to receive open baskets containing the goods to be degreased, a lifting means to lower the basket-holder into and lift it out of the solvent, a rotary means to set the basket-holder in rotation, and a lid fitted in the basket-holder to close the basket during the degreasing operation. The basket-holder is provided with levers to open and close the basket automatically. One end of the levers engages the lid to lift it and to lower it. The other end of the levers are arranged to come into contact with a stationary stop as the basket-holder approaches its highest position. This contact makes the levers turn, thus lifting the lid.

3 Claims, 2 Drawing Figures

DEGREASING APPARATUS

The invention relates to a degreasing apparatus of the type comprising a container for liquid or gaseous solvent, a basket-holder arranged to receive open baskets containing the goods to be degreased, a lifting means to lower the basket-holder into and lift it out of the solvent, a rotary means to set the basket-holder in rotation, and a lid fitted in the basket-holder to close the basket during the degreasing operation.

In a degreasing apparatus of this type the basket-holder is lowered together with basket and the goods therein into the solvent, usually a chlorinated hydrocarbon such as trichlorethylene. The solvent may be in liquid form or in vaporized form. in the latter case the steam condenses on the goods and dissolves grease and oil.

To enable the solvent to reach all parts of the surface of the goods, and also to allow it to run off properly, the apparatus is provided with a rotary means to set the basket-holder in rotation, primarily while the basket-holder is immersed in the solvent, and preferably also while it is on its way up again. A lid is provided in the basket-holder to close the open basket so that the goods remain there during rotation. The object of the invention is to provide an improved type of lid which will close and open the basket automatically and which is also securely prevented from opening during rotation.

The degreasing apparatus according to the invention is characterized in that the basket-holder includes levers arranged to cooperate with the lid and also, during the lifting movement of the basket-holder, to come into contact with a stationary stop and thus lift the lid from the basket when the basket-holder is in its highest position.

The invention will be described in the following with reference to the drawing.

Figure 1:
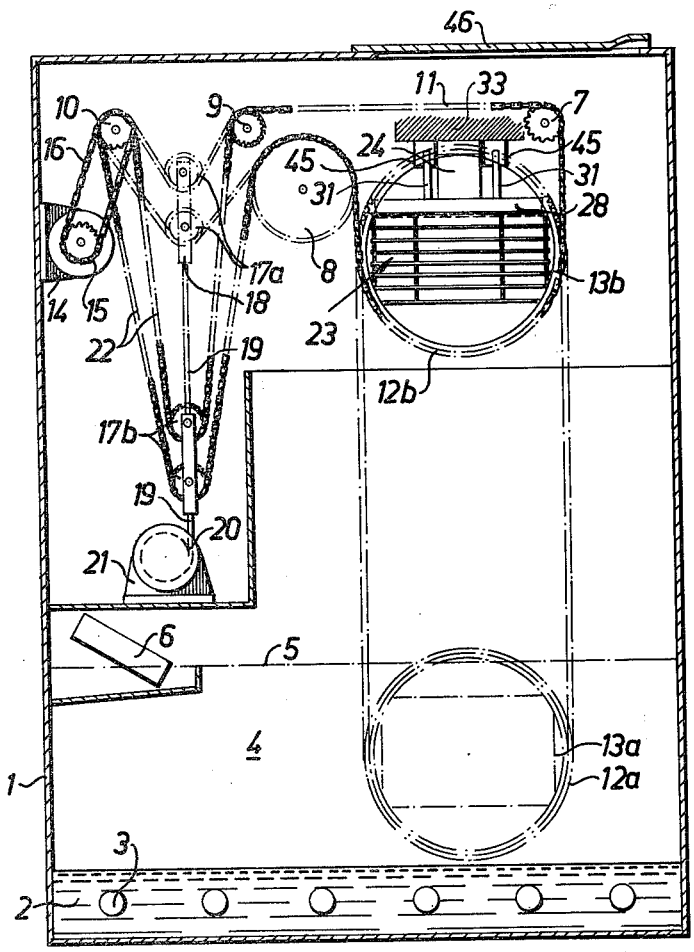
FIG. 1 shows a vertical section through a degreasing apparatus according to the invention.

The apparatus comprises a container 1 having a lid 46 on the top and a space 2 at the bottom for liquid solvent. The solvent can be brought to the boil by means of electrical immersion heaters 3. The vapour formed produces a vapour zone 4. The upper surface 5 of this zone is determined by a cooler 6 on which the vapour condenses. The condensate runs back into the liquid zone 2. Close to each of two opposite walls of the upper part of the container 1 are four rollers in the form of sprocket wheels 7 - 10. An endless chain 11 passes over these sprocket wheels and also around an annular sprocket wheel 12 fitted on a frame 13 forming a holder for perforated baskets 23 containing goods for degreasing. The baskets are inserted and withdrawn from the basket-holder 12, 13 from the side, through the open sprocket wheel 12.

A motor 14 is fitted in the upper part of the container 1 and drives the sprocket wheel 10 via a sprocket wheel 15 and chain 16. The endless chain 11 is thus set in motion and the basket-holder 12, 13 will consequently start rotating.

Two sprocket wheels 17 are arranged to cooperate with the two parts of the endless chain 11 located between the stationary sprocket wheels 9 and 10. The sprocket wheels 17 are mounted on a holder 18 secured to a wire 19 which can be wound by a motor 21 onto a winding drum 20 located approximately halfway up the container. When the sprocket wheel 17 is pulled down, the endless chain 11 will be pulled down to form two loops 22. The loop carrying the wheel 12 will be correspondingly shortened and the basket-holder 12, 13 will therefore be lifted at a speed which is twice as fast as the speed of the sprocket wheels 17. When the sprocket wheels 17 are at their highest point **17*a*, the holder 12, 13 will be in its lowest position 12*a*, 13*a*, that is to say in the vapour zone 4. When the sprocket wheels 17 are in their lowest position 17*b*, the holder 12, 13 will be in its highest position 12*b*, 13*b* in the upper part of the container 1**.

To prevent the goods from falling out of the basket 23 during rotation, a lid 25 is fitted in the holder 12, 13. The lid has a flat bottom 26 and slanting edges 27 designed to cooperate with the upper edge section 28 of the basket 23. The lid is held by two pairs of cross levers 31 pivotable about a horizontal axis 34. The axis 34 is fastened to the basket-holder by means of members 24. The levers 31 are actuated by tension springs 41. Each lever 31 is connected at its lower end by a joint 42 to a shorter lever 43, the lower end of which is bendably secured on a nib 44 on the upper side of the lid 25. The joint 42 is located at the side of the lever 31, 43 in such a way that the straight lever which is formed by the two parts 31, 43 can only be bent in one direction, as shown by the broken lines in FIG. 2. In the position shown by the unbroken lines in FIG. 2, the tension spring 41 holds the joint 42 in "locked" position, i.e. pressure in axial direction on the composite lever 31, 43 cannot bend the lever at the joint 42. Two parallel, horizontal beams 33 are fitted in the upper part of the container 1. These act as stops for the upper ends of the levers 31. To facilitate movement of the levers 31 along the beams 33, the upper end of each arm 31 has been provided with a roller 45. When the basket-holder 12, 13 is lifted to approach its uppermost position **12*b*, 13*b*, the levers 31 will come into contact with the stop 33. Continued lifting of the basket-holder results in the levers being turned by the stop 33 to the horizontal position 31*a*, against the action of the tension springs 41. The shorter lever 43 has thus been turned to position 43*a*. Levers 31 have now lifted the lid 25 enough to free it from the basket 23. The basket can thus be removed from the holder and a new basket be inserted. When the basket holder 12, 13 is lowered the levers 31 leave the stop 33 and the lid 25 is lowered by its own weight to close the basket 23. Due to the action of the tension springs 41, the levers 31 and the shorter levers 43 return to the position shown by the unborken lines. In this position the lid 25 is firmly secured on the basket. Pressure from the under side of the lid will not lift it from the basket. For this to happen the lever 31, 43 would have to be bent at the joint 42, and this is prevented by the tension spring 41**. Thus the goods in the basket cannot remove the lid from the basket during rotation.

Figure 2:
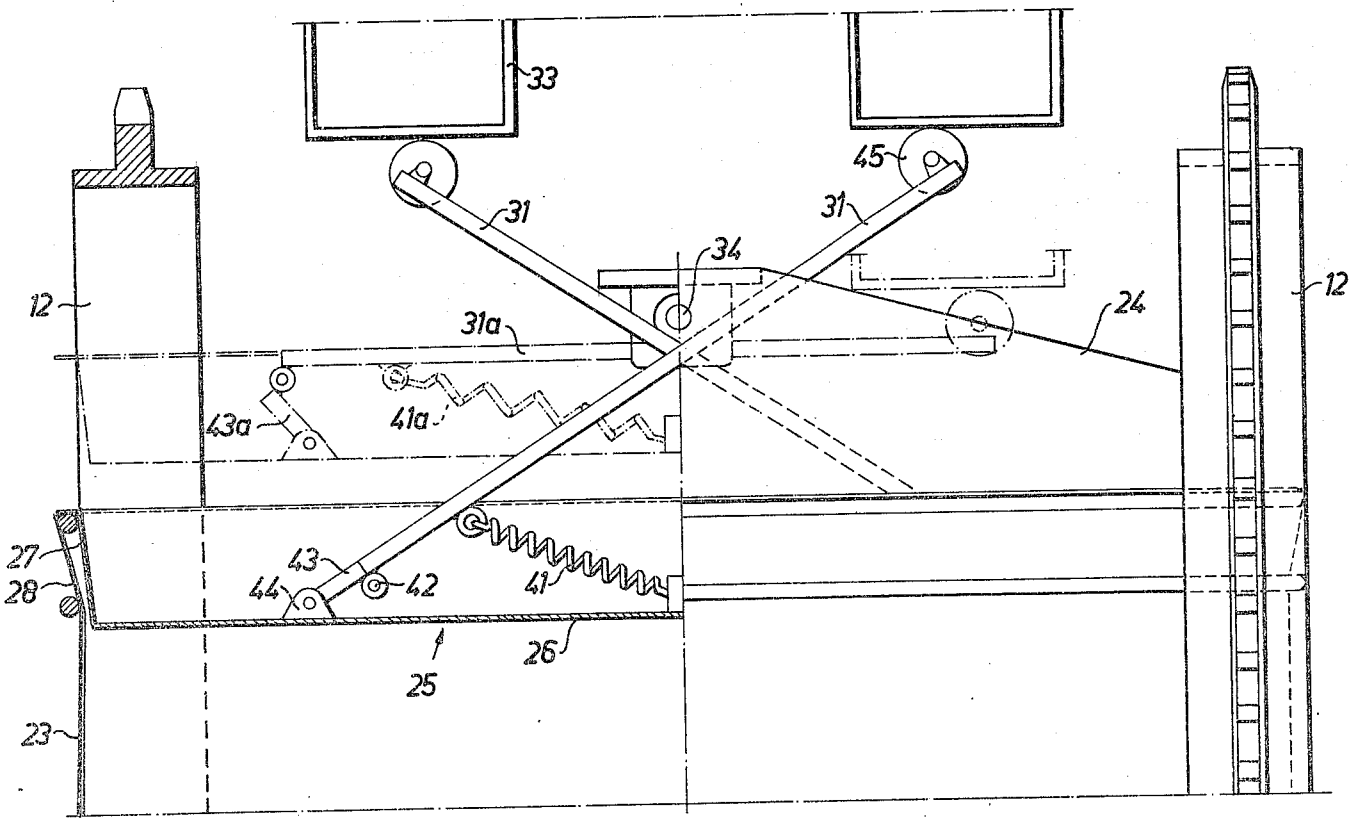
FIG. 2 shows the basket and the lid on a larger scale.

The apparatus shown thus operates in the following manner: A basket 23 is placed in the basket-holder 12, 13 when this is in its highest position. The motor 21 starts and lowers the basket-holder, whereupon the lid 25 is lowered and closes the basket 23. The basket-holder continues its downward movement, and only at this stage does the motor 14 come into action and cause the basket-holder to rotate. The holder is lowered into the vapour zone 4 while being rotated, and the vapour from the solvent condenses on the cold objects in the basket. The condensate dissolves grease and oil and runs down into the space 2. When the objects to be degreased have reached the temperature of the vapour, condensation will cease. The motor 21 then starts and lifts the basket-holder 12, 13, still being rotated in order to facilitate removal of the condensate. The motor 14 stops when the basket 23 is in a position with the lid uppermost, and the lifting movement continues until the lid has been lifted from the basket as shown in FIG. 2. The basket 23 is then removed from the holder and a new basket can be inserted.

What is claimed is:

1. Degreasing apparatus comprising a container (1) for liquid or gaseous solvent, a basket-holder (12, 13) arranged to receive open baskets (23) containing the goods to be degreased, a lifting means (17 - 22) to lower the basket-holder (12, 13) into and lift it out of the solvent, a rotary means (14 -16) to set the basket-holder (12, 13) in rotation, and a lid (25) fitted in the basket-holder (12, 13) to close the basket (23) during the degreasing operation, characterized in that the basket-holder (12, 13) includes levers (31) arranged to cooperate with the lid (25) and also, during the lifting movement of the basket-holder (12, 13), to come into contact with a stationary stop (33) and thus lift the lid (25) from the basket (23) when the basket-holder (12, 13) is in its highest position.

2. Degreasing apparatus according to claim 1, characterized in that the basket-holder (12, 13) includes at least one pair of crossed levers (31), the lower ends of which are attached to the lid (25).

3. Degreasing apparatus according to claim 2, characterized in that the levers consist of two parts (31, 43) connected by a joint (42) which permits bending in one direction only, whereupon a tension spring (41) is arranged to activate the lever in a direction corresponding to locked position of the joint (42).

* * * * *